US006050182A

United States Patent [19]

Arsenault et al.

[11] Patent Number: 6,050,182

[45] Date of Patent: Apr. 18, 2000

[54] INFLATABLE BALLOON COLOR PRINTING PROCESS AND APPARATUS

[76] Inventors: Germain Arsenault, 2460 rang Augusta, St-Angtèle de Prémont, Québec, Canada, J0K LR0; André Prévost, 125 Beaumont, St-Constant, Quebec, Canada, J5A 2G6

[21] Appl. No.: 09/252,425

[22] Filed: Feb. 18, 1999

[51] Int. Cl.[7] ..... B41F 15/04; B41F 17/30

[52] U.S. Cl. ..... 101/38.1; 101/39; 101/115

[58] Field of Search ..... 101/35, 38.1, 114, 101/115, 39, 36

[56] References Cited

U.S. PATENT DOCUMENTS

| | | | |
|---|---|---|---|
| 1,870,825 | 8/1932 | Sprague | 101/35 |
| 1,988,662 | 1/1935 | Myers | 101/36 |
| 2,016,450 | 10/1935 | Myers | 101/35 |
| 2,645,870 | 7/1953 | Smith et al. | 41/1 |
| 3,224,364 | 12/1965 | Terzuoli | 101/37 |
| 3,868,899 | 3/1975 | Nye et al. . | |
| 3,983,809 | 3/1976 | Nye et al. . | |
| 4,478,142 | 10/1984 | Santorineos . | |
| 4,829,894 | 5/1989 | Gardner . | |
| 5,368,808 | 11/1994 | Koike et al. . | |
| 5,887,519 | 3/1999 | Zelko | 101/115 |

FOREIGN PATENT DOCUMENTS

| | | | |
|---|---|---|---|
| 3-55077573 | 6/1980 | Japan | B41F 17/00 |
| 3-60212351 | 10/1985 | Japan | B41F 17/14 |

OTHER PUBLICATIONS

Hokiday Jubilee? 96, Convention Brochure Held at Hyatt Regency O'Hare, Rosemont, IL (Chicago). 5 Sheets, Aug. 1996.

Balloons & Parties decorating ideas—parties and events Festivities Publications, Inc., Jacksonville, FL, 32204–1423, Jul./Aug. 1996.

Tomorrow's Automatic Balloon Printing Machines—Catalogue—, R.I.F.C.O., Italy, Date Unknown.

*Primary Examiner*—Kimberly Asher
*Attorney, Agent, or Firm*—F. Martineau

[57] ABSTRACT

A balloon printing apparatus for printing an image on the outer surface of a number of inflatable elastic balloons of the type defining a main body and a neck opening allowing access into the main body. The apparatus comprises: a conveyor device movable in a closed path in an intermittent manner; a plurality of nozzles spacedly carried by the conveyor device, insertable into a balloon neck opening and for inflating a balloon; as many balloon supporting frames as air nozzles, carried by the conveyor device, each nozzle adjacent to a corresponding frame, each frame sized to partly surround and support the main body of an inflated balloon installed on the adjacent nozzle with a portion of the inflated balloon protruding from the frame. The body remains in a stable position relative to the conveyor device while the inflated balloon is transported by the nozzle and frame through the closed path. A number of stations are located along the conveyor device and comprises a balloon installing station for successively installing the balloons on the nozzles. At least one balloon inflating station is provided wherein the nozzles inflate the balloons which fit inside their respective frames, and at least one balloon printing station is also provided in which a printing plate moves towards a frame stopped at the station and apply ink onto the protruding portion of the inflated balloon supported by the stopped frame.

12 Claims, 11 Drawing Sheets

INFLATABLE BALLOON COLOR PRINTING PROCESS AND APPARATUS

FIELD OF THE INVENTION

The invention relates to an apparatus and process for printing inflatable balloons, and more particularly to an apparatus and process for printing inflatable balloons in a stable fashion.

BACKGROUND OF THE INVENTION

Inflatable balloon printing devices are well known for applying colour drawings or letterings on the external balloon surface, usually for advertisement purposes. A known method of applying colour on a balloon is a silk screen process, in which the balloon is inflated, and biased against an ink permeable silk screen until the balloon is yieldingly deformed against the screen so as to obtain a temporarily flat balloon surface in contact with the silk screen. Colour is then applied on this flat balloon surface through the silk screen, with a wiper that horizontally runs along the screen. The balloon is then removed from the silk screen, and retrieves its original shape, with the desired design now inprinted on the balloon surface. Several colours can be applied in this fashion by moving the balloon through sequential colour printing stations. For example, on a light-coloured balloon such as a white balloon, four colouring stations could be used, one station for black colour printing, and three stations for printing the three primary colours, i.e. red, yellow and blue.

Balloon printing apparatuses have been devised over the years which include a number of sequential stations, namely a station for installing the balloon on the apparatus, an inflating station for inflating the balloon, several colour printing stations for applying the colour on the balloon surface, a drying station for speeding up the ink colour drying of the balloon, and a removal station for removing the balloon from the apparatus, and possibly simultaneously removing the air from the inflated balloon.

An important problem associated with the conventional apparatuses as described above is that they may allow, in their sequential colour printing stations, the different colours to become slightly offset relative to one another, thus blurring the image on the balloon. Indeed, a slight accidental displacement of the balloon, due to air currents or the acceleration and deceleration sudden stepwise movements of the balloon from one station to the other, may cause a difference in the position of the balloon during printing relative to its desired position, resulting in the colour being printed thereon at an offset position. The image printed on the balloon may consequently be undesirably blurred and unclear due to poor colour registration, which is called the shadow effect.

Means for stabilizing the balloon have been devised, such as in U.S. Pat. No. 4,478,142 issued in 1984 to C. Santorineos. In this patent, a balloon carrying member comprising a ring holds the balloon around its neck portion while it is moved from one station to another. However, tilting motion of the balloon is not prevented with this device, and the balloon may still move relative to its ring member from one station to another. The Santorineos patent also shows a vertically movable cup-like cradle which underlies and supports the balloon during the printing operations. However, this cradle does not follow the balloon from one station to another, and thus the balloon remains unsupported between stations, while a cradle engages the balloon at each printing station. The balloon is thus prone to move relative to its ring member from one station to another and to be pushed by the next cradle in an incorrect position against the next silk screen.

OBJECTS OF THE INVENTION

It is the gist of the present invention to provide a balloon printing apparatus which allows the balloon to be stably supported while it is printed.

SUMMARY OF THE INVENTION

The invention consists of a balloon printing apparatus for printing an image on the outer surface of a number of inflatable elastic balloons of the type defining a main body and a neck opening allowing access into said main body, said apparatus comprising: a conveyor device movable in a closed path in an intermittent manner; a plurality of nozzles spacedly carried by said conveyor device, insertable into a balloon neck opening and for inflating a balloon; as many balloon supporting frames as air nozzles, carried by said conveyor device, each nozzle adjacent to a corresponding frame, each frame sized to partly surround and support the main body of an inflated balloon installed on the adjacent nozzle with a portion of said inflated balloon protruding from said frame, said body remaining in a stable position relative to said conveyor device while said inflated balloon is transported by said nozzle and frame through said close path; a number of stations located along said conveyor device and comprising: a balloon installing station for successively installing the balloons on said nozzles, and at least one balloon inflating station is provided wherein said nozzle inflates said balloons which fit inside their respective frames, and at least one balloon printing station is also provided in which a printing plate moves towards a frame stopped at said station and applies ink onto the protruding portion of the inflated balloon supported by said stopped frame.

DETAILED DESCRIPTION OF THE EMBODIMENTS

Figure 1:
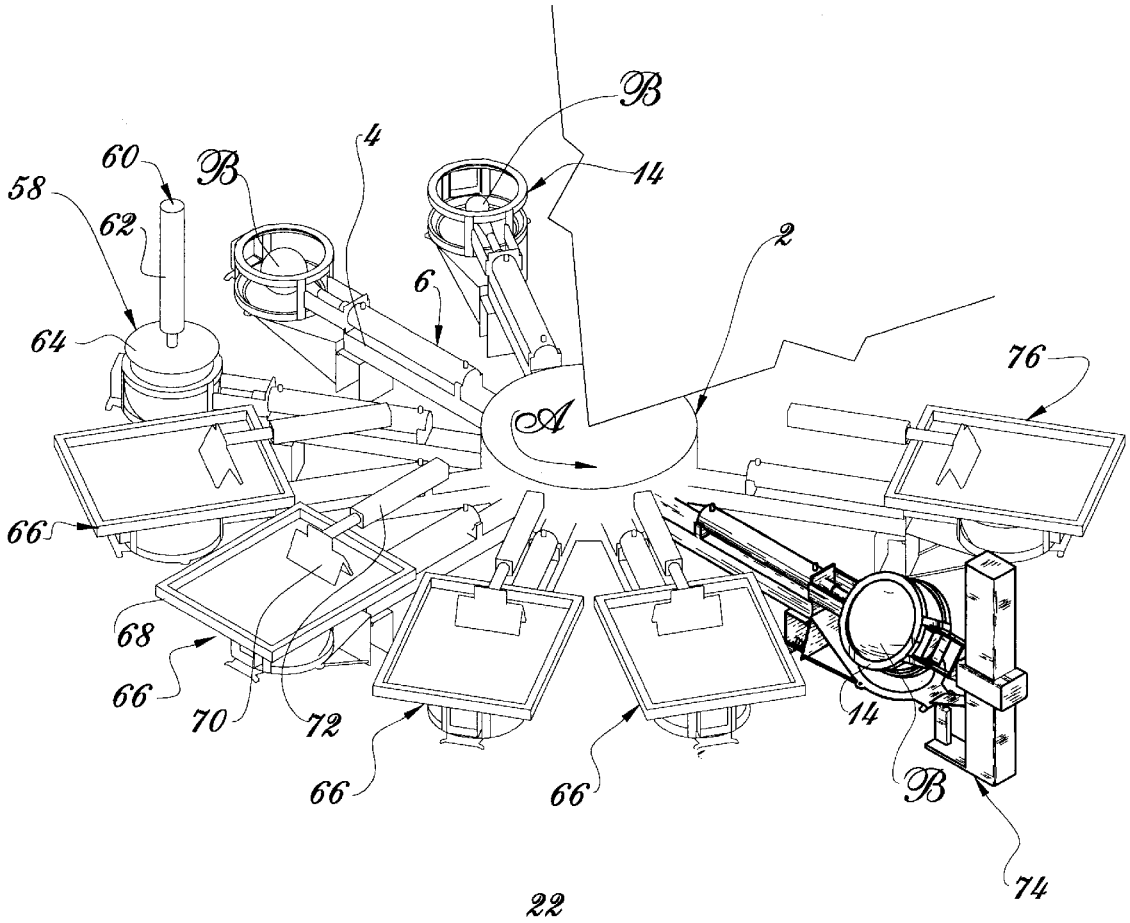
FIG. 1 is a partial perspective view of the apparatus of the invention.

Referring to FIG. 1, there is shown a turn table 2 generally comprising a plurality of radial arms 4 and rotatable in an intermittent manner by a drive (not shown) about a vertical axis in the direction indicated by arrow A.

On the radially outer portion of each radial arm 4 is secured an aligned double acting hydraulic actuator 6, including a cylinder 8 fixed to arm 4 and a piston rod in the form of a tube 10 connected to an air supply at the radially inner end of the cylinder 8. The radially outer end air supply tube 10 is fitted with a balloon inflating nozzle 12 of conventional construction and including a check valve. An elastic balloon B having the usual body and neck is installed on the nozzle 12 to be inflated. Elements 6, 8, 10 and 12 form a balloon installing station.

The apparatus further includes a frame or cage 14 for surrounding an inflated balloon B. The cage 14 is secured to a bracket 16 which is rotatable about a bushing 18 fixed to the radially outer end of actuator cylinder 8 and surrounding air supply tube 10. Bushing 18 has means to prevent axial movement of the cage 14 and bracket 16 but cage 14 is free to rotate about the axis of tube 10.

The cage 14 is composed of two spaced parallel frame sections 20, each in the form of a ring, in the preferred embodiment, and each frame is connected to the other by transverse links 22 and by a mouth member 24 of generally rectangular shape and fixed to the radially outer portion of the cage 14.

Figure 2:
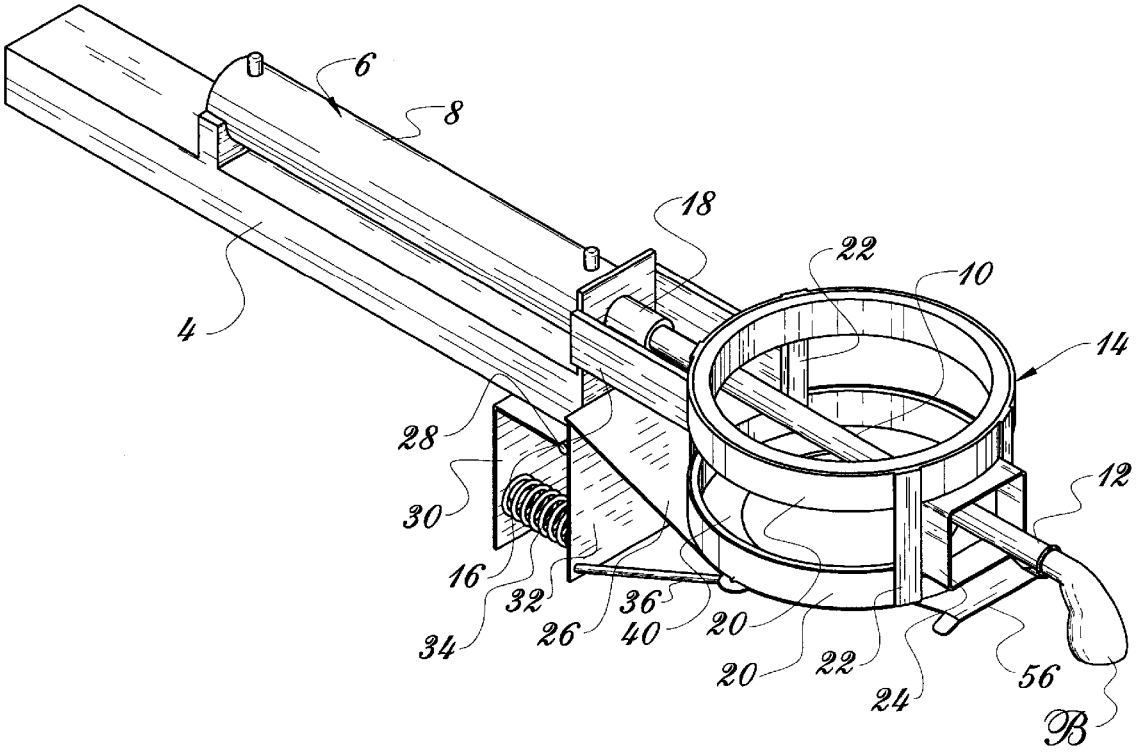
FIG. 2 is a perspective view of the assembly of one arm member with the encircling frame and the balloon inflating nozzle assembly mounted thereon, the nozzle being at an extended position for balloon installation.
Figure 3:
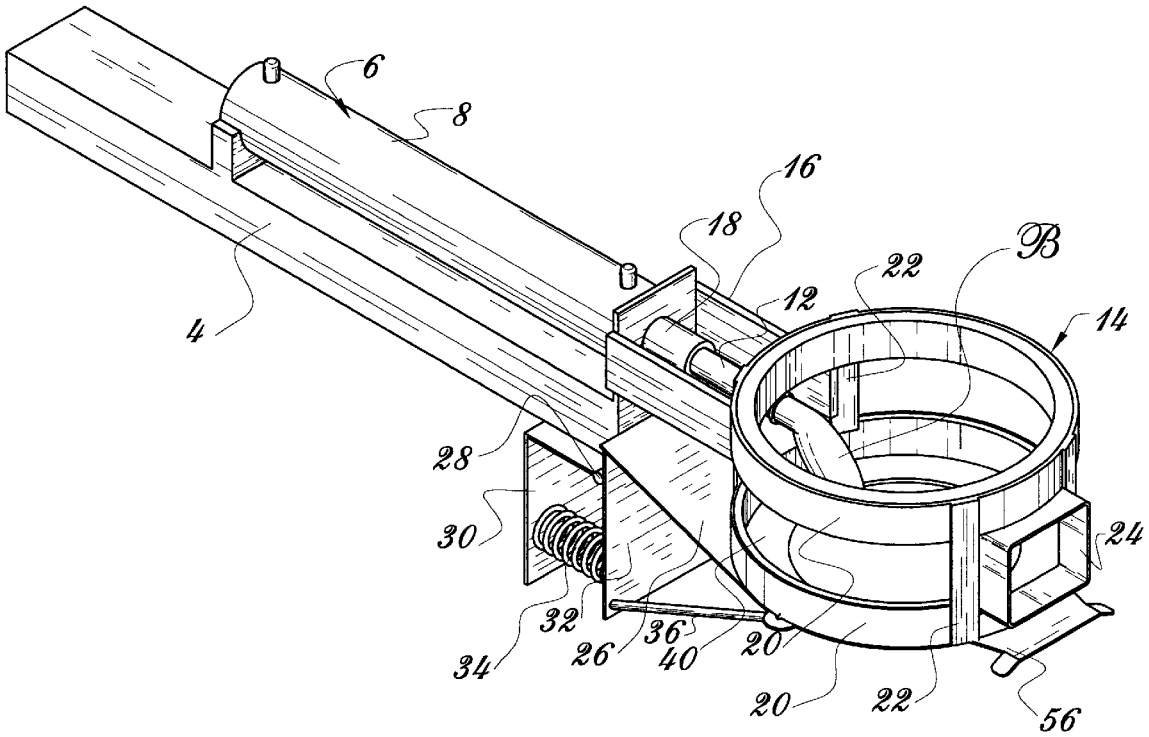
FIG. 3 is a view similar to that of FIG. 2 but with the balloon inflating nozzle in retracted position ready for balloon inflation.
Figure 4:
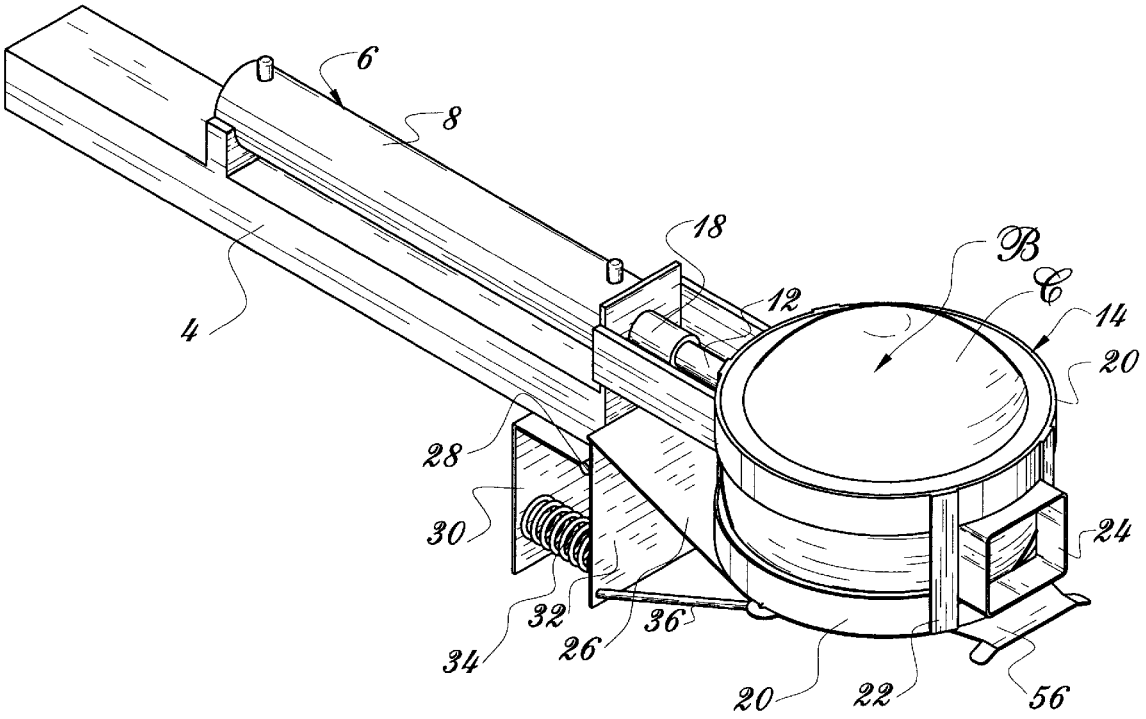
FIG. 4 is a perspective view similar to that of FIG. 3 but showing an inflated balloon within the frame, ready to be printed.
Figure 5:
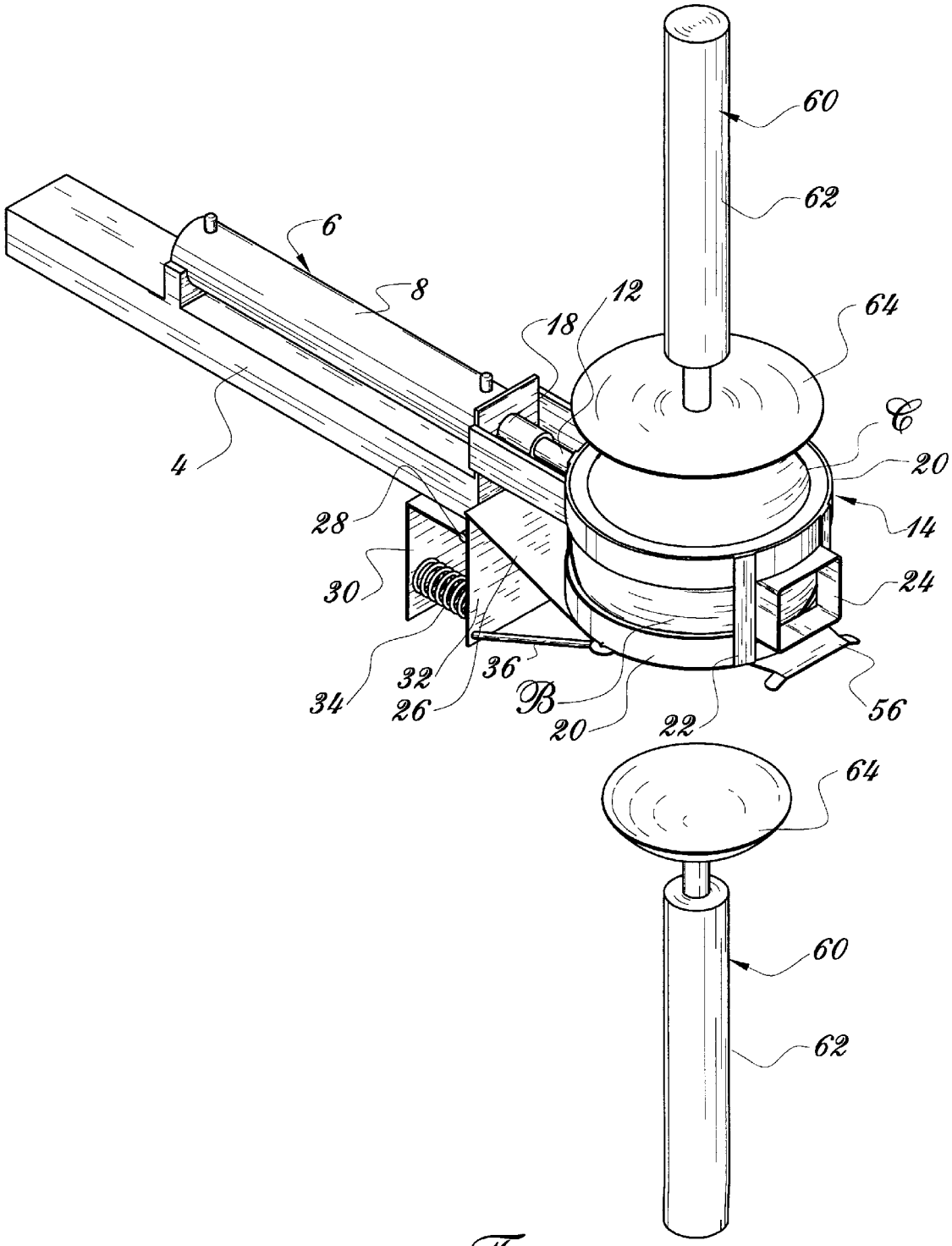
FIG. 5 is a view similar to that of FIG. 4 but showing opposed pushers to center the inflated balloon within the frame.
Figure 6:
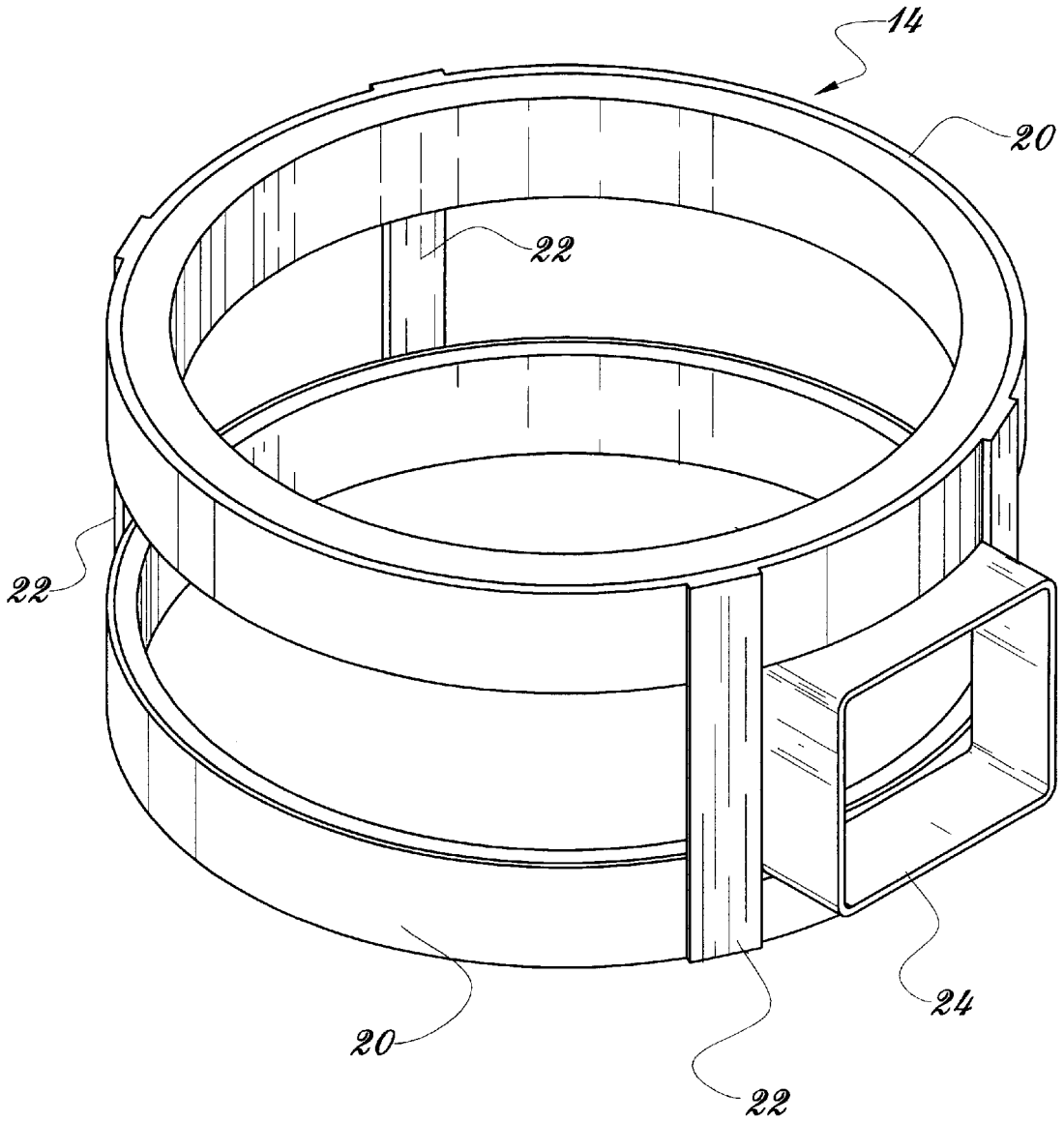
FIG. 6 is a perspective view, on an enlarged scale, of the frame of the invention.
Figure 7:
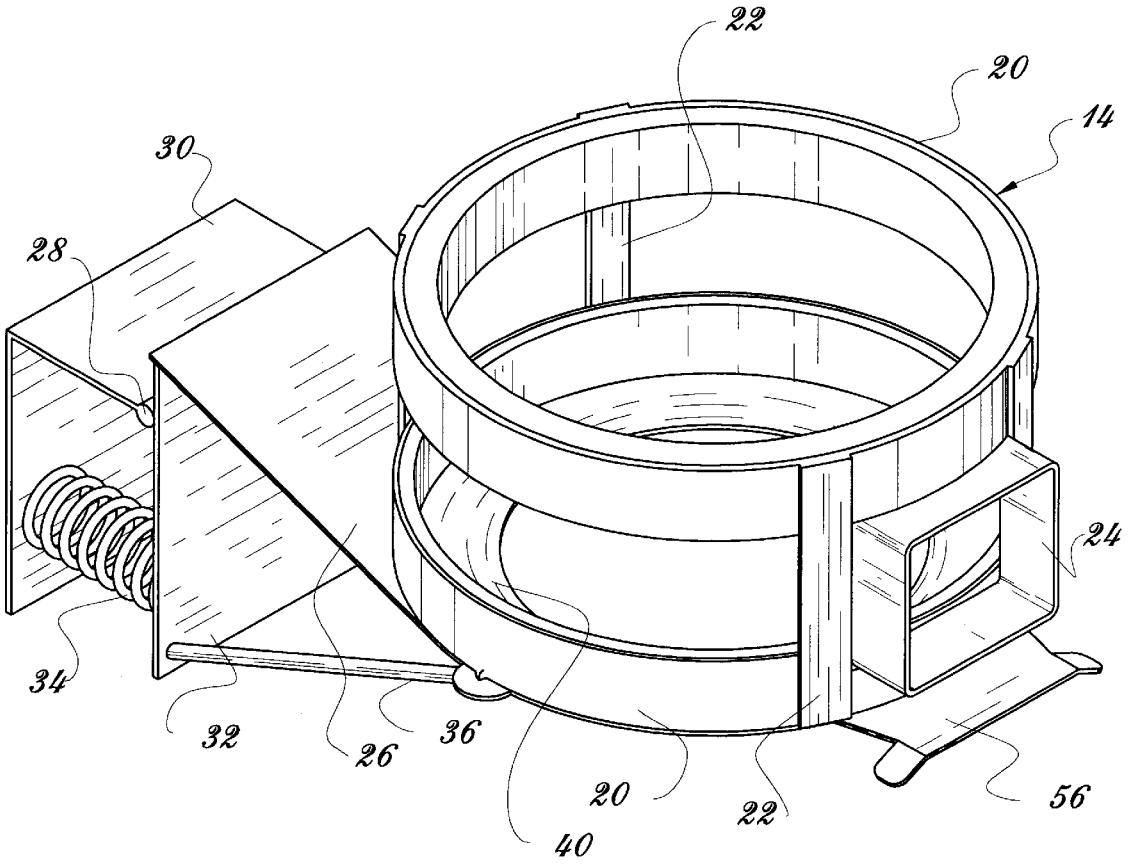
FIGS. 7 and 8 are perspective views, on an enlarged scale, of the frame with the frame rotation locking device in operative and inoperative position respectively.
Figure 8:
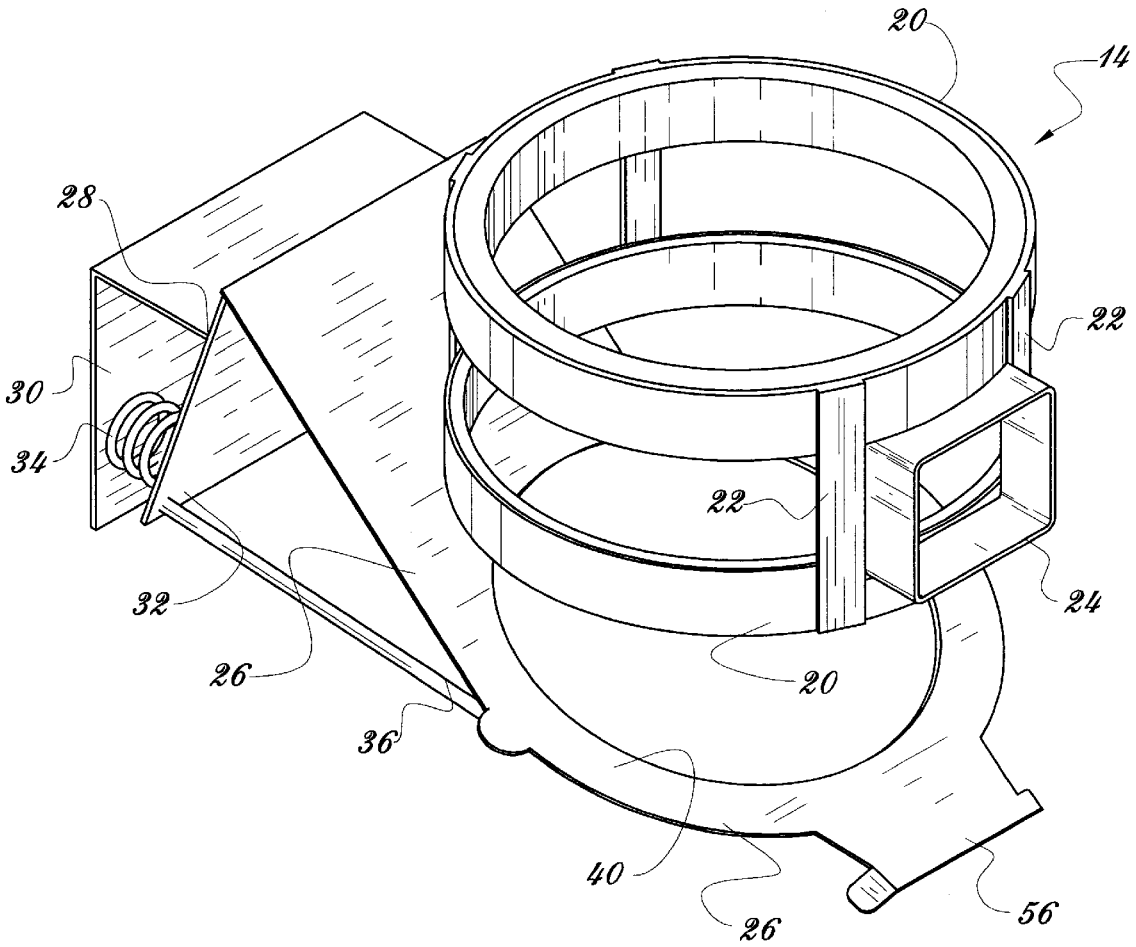
Figure 9:
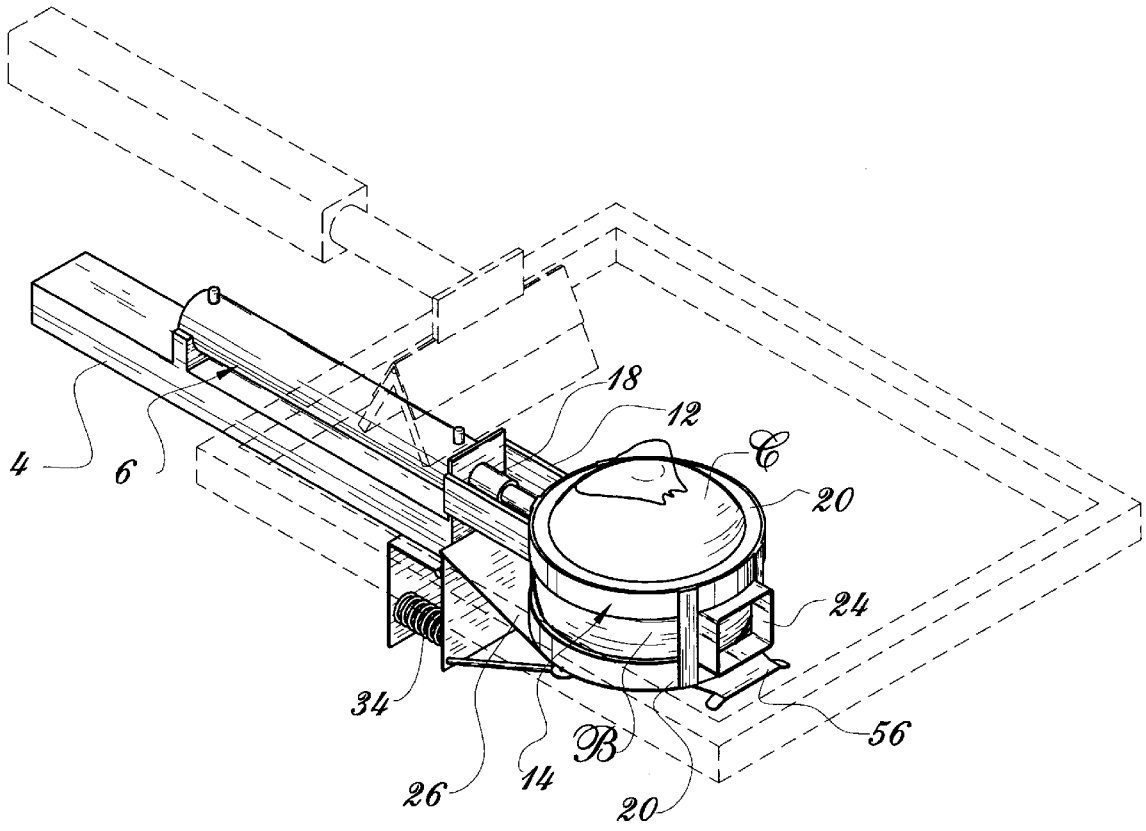
FIG. 9 is a perspective view similar to that of FIG. 4 but showing the relative position of the silk screen at a printing station.

The actuator is arranged to advance nozzle 12 to an outward position, as shown in FIG. 2 in which the nozzle 12 protrudes from cage 14 through the mouth member 24 for easy installation of a balloon B on the nozzle 12. The nozzle can be retracted by the actuator 6 to a retracted position as shown in FIG. 3 in which the non-inflated balloon B hangs inside the cage 14, ready for inflation.

The air supply tube 10 and nozzle 12 extend midway between the two frame sections 20.

Figure 11:
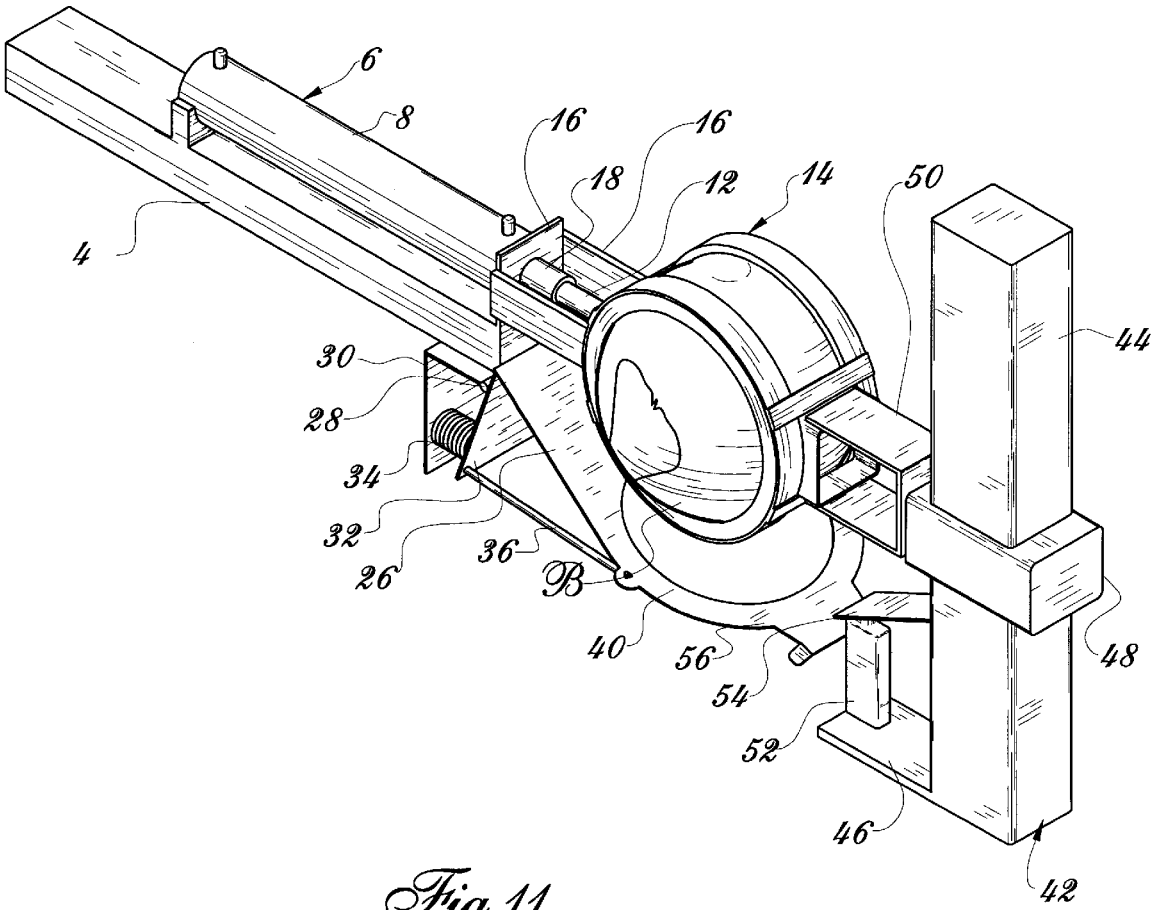
FIG. 11 is a perspective view as in FIG. 10 but showing the frame locking device in unlocking frame clearing position, the frame rotated through one quarter turn.

A cage locking plate 26 is pivoted by means of a hinge 28 to an angle iron 30 secured to the underside of the radially outer end of arm 4; plate 26 has an angled leg 32 as shown in FIG. 11 which is spaced from an angle iron 30. One or more compression springs 34 are disposed between the angle leg 32 and angle iron 30 so as to bias each locking plate 26 towards cage 14 so as to releasably lock the same in one or the other of two cages rotated positions at 180° from each other.

Reinforcing rods 36 extend between angle leg 32 and locking plate 26.

Plate 26 has a circular opening of smaller diameter than the circular opening of the two frame sections 20 to define a lip 40 which extends within the cage under the same and the locking plate 26 is engaged in locking position as shown in FIG. 3.

Figure 10:
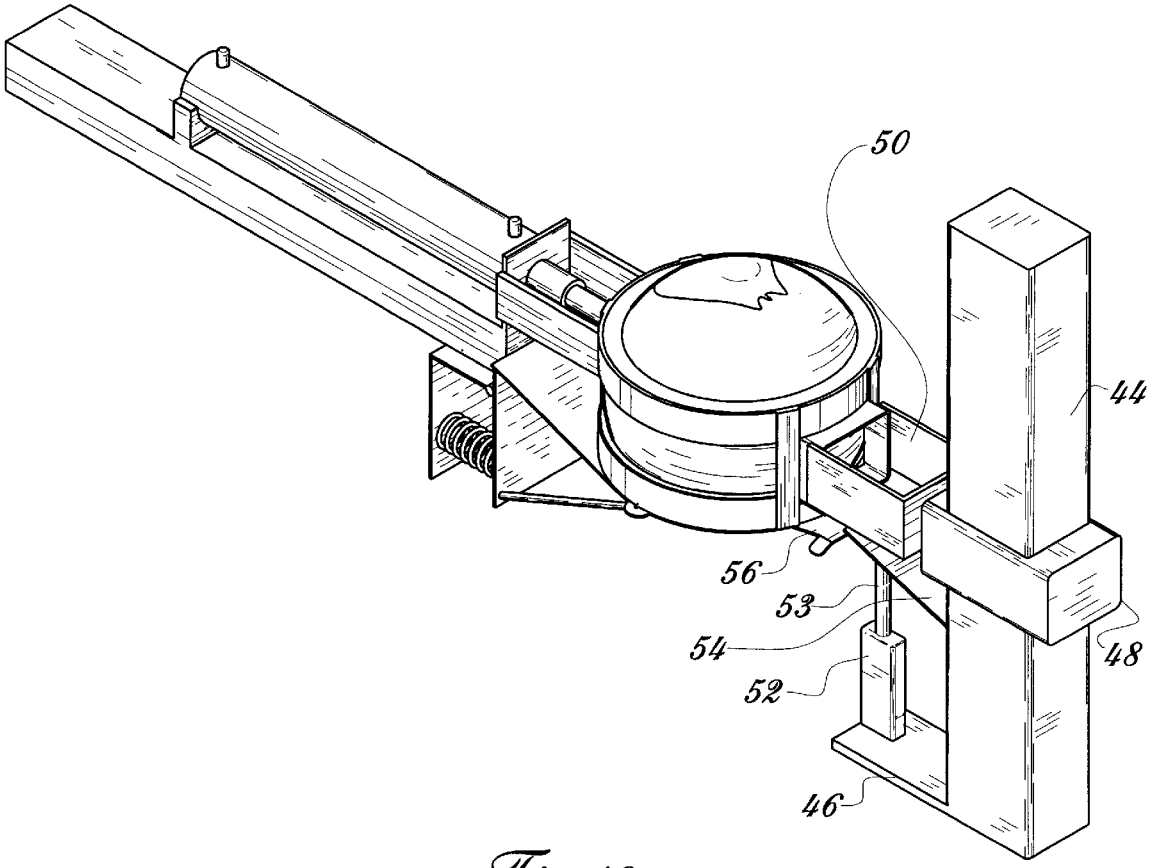
FIG. 10 is a perspective view of the assembly of FIG. 1 and showing the frame locking device in locking positon.

The apparatus of the invention further includes, as shown in FIGS. 10 and 11, a cage rotating and locking plate releasing assembly generally indicated at 42. This assembly includes a post 44 mounted on a ground base 46 and surrounded by a vertically movable sleeve 48 which carries a motor actuating a cage rotating U-shape member 50. An upright ram 52 is mounted on base 46 and its piston rod 53 is attached to a lever arm 54 pivoted to post 44 below sleeve 48. Lever arm 54 is adapted to engage and downwardly pull outer extension 56 of cage locking plate 26. Lever arm 54 actuated by ram 52 serves as a locking plate releasing device, since it downwardly pivots locking plate 26 against the bias of compression spring 34 to a cage releasing position in which it completely clears the cage 14 (see FIG. 11) so that the latter may be rotated about the air supply tube axis. Once cage 14 is rotated as suggested from the sequence of FIGS. 10 and 11, sleeve 48 moves upwardly so that the U-shape cage rotating member, 40, can release the mouth member 24, and the cage 14 can then be transported to another location.

All around the turn table 2 with its radial arms 4 and cages 14 are disposed various stations, namely a balloon installing station 6–12 followed by several inflating stations generally indicated at 58, the last station 58 including a pair of vertically movable pusher members 60 above and below fully inflated balloon B at this station (see FIGS. 1–2). Each pusher member includes a double acting ram 62 to the piston rod of which is secured a disc 64 conforming to an inflated balloon and adapted to move toward each other in a synchronised manner to center a fully inflated balloon relative to cage 14 at the station so that the balloon will have a protruding portion C of substantially equal dimension on each of the two opposite sides of the cage 14. However, the lower balloon protruding portion C will rest on the protruding lip 40 of cage locking plate 26 for a purpose to be described hereinafter. The number of inflating stations 58 depends on the time it takes to fully inflate the balloons relative to the time required for balloon printing at one printing station. The balloon inflating stations are followed by a first set of screen printing stations 66; in the example shown, there are four printing stations 66 each including a printing plate consisting of a silk screen 68 with an ink wiper 70 actuated by a ram 72 for successively printing different colours.

The assembly of elements 60, 70 and 72 are mounted on a device which moves the silk screen up and down in register with a cage enclosed inflated balloon at a stopped printing station. The silk screen 68, during its balloon printing operation, moves down towards and against the inflated balloon and deformingly flattens the same to the level of the top edge of the upper frame section 20. Since the balloon is firmly held within the cage 14 while moving from one station to the other and while accelerating and decelerating during the intermittent rotating movement of the turn table 2, good colour registration is obtained when printing a multi coloured image on the protruding portion C of the balloon.

The ink supply and operation of the silk screen is a conventional system and is not shown.

Printing stations 66 are followed by a cage rotating station 74. As shown in FIG. 11, the cage locking plate 26 is depressed by the arm 54 under the action of the upright ram 52, and the cage 14 is rotated about the axis of the air supply tube 10 by means of the motor actuated cage rotating U-shape member 50, after the latter has moved downwardly to engage the sides of the mouth member 24 of the cage 14.

Once cage 14 and enclosed balloon have been rotated through half a turn, member 50 is moved upwardly by sleeve 48 to clear mouth 24. The balloon is transported step by step through a second set of printing stations one of which is indicated at 76, the other stations not being shown. The diametrically opposite portion C of the balloon body is printed in the same manner as at printing station 66. The second set of printing stations 76 is followed by ink drying stations and finally by a balloon ejecting and deflating station, not shown and of conventional construction.

From the foregoing, it is clear that the inflated balloon is firmly held in the same position with respect to the rotating turn table 2 during transport from one station to the other so as to obtain good colour registration on the balloon. Also, it is noted that the protruding lip 40 acts as a stop to prevent downward displacement of the inflated balloon within the enclosing cage 14 during downward printing movement of the silk screen 68.

The apparatus of the invention is suited to be used in conjunctions with any other type of printing process such as those using rotary printing cylinders instead of flat silk screens as shown.

We claim:

1. A balloon printing apparatus for printing an image on the outer surface of a number of inflatable elastic balloons of the type defining a main body and a neck opening allowing access into said main body, said apparatus comprising:

a) a conveyor device movable in a closed path in an intermittent manner;

b) a plurality of nozzles spacedly carried by said conveyor device, insertable into a balloon neck opening and for inflating a balloon;

c) as many balloon supporting frames as air nozzles, carried by said conveyor device, each nozzle adjacent to a corresponding frame, each frame sized to partly surround and support the main body of an inflated balloon installed on the adjacent nozzle with a portion of said inflated balloon protruding from said frame, said body remaining in a stable position relative to said conveyor device while said inflated balloon is transported by said nozzle and frame through said closed path;

d) a number of stations located along said conveyor device and comprising:

a balloon installing station for successively installing the balloons on said nozzles;

at least one balloon inflating station, wherein the balloons are inflatable by said nozzles upon the ballons fitting inside their respective frames, and at least one balloon printing station in which a printing plate is movable towards a frame stopped at said station and in which ink is applicable onto the protruding portion of the inflated balloon supported by said stopped frame;

wherein said supporting frame comprises a pair of similar, spaced, parallel frame sections, each having an opening which registers with the opening of the other frame section and which is of a shape conforming to the cross-sectional shape of the inflated balloon and of a size smaller than the maximum cross-sectional size of the inflated balloon.

2. A balloon printing apparatus as defined in claim 1, wherein there are at least two balloon printing stations in each of which a printing plate is located, said plates applying inks of different colours onto said protruding portion of the inflated balloon to obtain a printed multi coloured image with good colour registration.

3. A balloon printing apparatus as defined in claim 1 and further including an inflated balloon positioning device including a pair of opposed pushers located at said inflating station and disposed on the outside of, centered with and movable toward and away from said pair of frame sections to center, relative to said frame section, an inflated balloon disposed between said frame sections with two portions protruding substantially equally exteriorly of the respective frame sections.

4. A balloon printing apparatus as defined in claim 3, wherein said frame is mounted on said conveyor device for rotation about a frame rotation axis midway between and extending across said pair of frame sections so that any one frame section can take the place of the other frame section upon a one half rotation of said frame about said frame rotation axis, so defining two operative positions of said frame with either frame section and balloon protruding portion facing said printing plate when said balloon is in printing position, and further including a releasable frame locking device to lock said frame into any one of said two operative positions.

5. A balloon printing apparatus as defined in claim 4, further including a frame rotating station, a motorized frame unlocking device and a motorized frame rotating device at said frame rotation station, to unlock and rotate said frame.

6. A balloon printing apparatus as defined in claim 1, further including an arm member, fixed to and outwardly extending from said conveyor device and to the outer end of which said frame is secured, a pressurized air supply tube connected to said nozzle and carried by said arm member for longitudinal reciprocating movement between and across said two frame sections from a first position in which said nozzle is disposed exteriorly of said frame for balloon installation at said balloon installing station and a second position in which said nozzle is disposed closer to said arm member so that the installed balloon can be inflated inside said frame at said balloon inflating station.

7. A balloon printing apparatus as defined in claim 6, further including an inflated balloon positioning device including a pair of opposed pushers located at said inflating station and disposed on the outside of, centered with and movable toward and away from said pair of frame sections to center relative to said frame sections, an inflated balloon disposed between said frame sections with two balloons portions protruding substantially equally exteriorly of the respective frame section.

8. A balloon printing apparatus as defined in claim 6, wherein said frame is mounted on said conveyor device for rotation about a frame rotation axis parallel to, about midway between and extending across said pair of frame sections so that any one frame section can take the place of the other frame section upon a one half rotation of said frame about said frame rotation axis, so defining two operative positions of said frame with either frame section and balloon protruding portion facing said printing plate when said balloon is in printing position, and further including a releasable frame locking device to lock said frame any one of said two operative positions.

9. A balloon printing apparatus as defined in claim 8, further including a frame rotating station, a motorized frame unlocking device and a motorized frame rotating device at said frame rotation station to unlock and rotate said frame.

10. A balloon printing apparatus as defined in claim 8, further including a cylinder and piston actuator mounted on said arm member coaxial with said frame rotation axis, the piston rod of said actuator forming said air supply tube, said actuator producing said reciprocating movement of said air supply tube and nozzle, said cylinder including a bushing extension surrounding said air supply tube and on which said frame is rotatably mounted for rotation about said frame rotation axis.

11. A balloon printing apparatus as defined in claim 10, wherein said frame locking device includes an apertured plate, hinged on said arm member adjacent said bushing and spring biased to a locking position in which said plate engages one or the other side of said frame, said plate pivotable away from said frame against said spring bias to clear said frame for its rotation, said plate in its locking position having its aperture in register with, but smaller than, said frame openings to restrict said openings while allowing said inflated balloon to protrude therethrough, the restriction of said openings preventing displacement of said inflated balloon in said frame, away from said printing plate during a printing operation.

12. In combination, a balloon colour printing apparatus including a conveyor device, nozzles spacedly carried by said conveyor device for inflating and holding an elastic balloon and differently coloured printing plates spaced along said conveyor device to successively depress and inflate balloons held by said nozzles and print a multi coloured image thereon and cages secured to said conveyor device, one for each nozzle, and including:

an open frame section, for surrounding the inflated balloon, a portion of the latter outwardly protruding from said frame section to be successively depressed by said printing plates, said cage transporting an enclosed inflated balloon to successive printing positions in register with said printing plates and with said projecting portion facing said printing plates;

wherein all of said printing plates are disposed above the path of said cages and corresponding said nozzles, each of said cages including two similar spaced parallel open frame sections, the inflated balloon surrounded by said cage having two opposed portions outwardly protruding from the respective frame sections, and further including a device to rotate said cages one half turn to bring both of said opposite protruding balloon portions into a printable position.

* * * * *